US005762260A

United States Patent [19]

Goglio

[11] Patent Number: 5,762,260

[45] Date of Patent: Jun. 9, 1998

[54] CONTAINER MADE OF FLEXIBLE SHEET MATERIAL

[76] Inventor: Luigi Goglio, VIA FRUA, 11—20146, Milano, Italy

[21] Appl. No.: 767,881

[22] Filed: Dec. 17, 1996

[30] Foreign Application Priority Data

Jan. 19, 1996 [IT] Italy ..... MI96U0036

[51] Int. Cl.[6] ..... B65D 5/50

[52] U.S. Cl. ..... 229/199; 383/89; 383/106; 383/119

[58] Field of Search ..... 229/125.42, 199; 383/82, 89, 104, 106, 119, 210

[56] References Cited

U.S. PATENT DOCUMENTS

| | | | |
|---|---|---|---|
| 1,814,685 | 7/1931 | Glass . | |
| 2,331,966 | 10/1943 | Eisgrau | 383/119 |
| 2,678,768 | 5/1954 | Vergobbi . | |
| 2,815,898 | 12/1957 | Thompson | 383/104 |
| 3,081,927 | 3/1963 | Hayhurst | 229/125.42 |
| 4,863,287 | 9/1989 | Marsik | 383/82 |
| 4,991,980 | 2/1991 | Cohen et al. | 383/104 |
| 5,009,518 | 4/1991 | Faltynek | 383/106 |
| 5,100,051 | 3/1992 | Triglia et al. | 383/119 |
| 5,348,400 | 9/1994 | Haiss et al. | 383/82 |

FOREIGN PATENT DOCUMENTS

| | | | |
|---|---|---|---|
| 0 522 326 B1 | 12/1995 | European Pat. Off. . | |
| 2 193 745 | 2/1974 | France . | |
| 8-091393 | 4/1996 | Japan . | |
| 48053 | 10/1939 | Netherlands . | |
| 300470 | 11/1928 | United Kingdom . | |
| 766160 | 1/1957 | United Kingdom . | |
| 2 081 676 | 2/1982 | United Kingdom . | |
| 2081676 | 2/1982 | United Kingdom | 383/104 |
| 2 173 169 | 10/1986 | United Kingdom . | |

OTHER PUBLICATIONS

"Its a Bag, Its a Box" advertisement, Packaging, vol. 30, No. 3, p. 100, Mar. 1985.

*Primary Examiner*—Gary E. Elkins

*Attorney, Agent, or Firm*—Burns, Doane Swecker & Mathis LLP

[57] ABSTRACT

A container is made of flexible sheet material, particularly for products with a solid consistency, obtained by successive folding and sealing of a sheet material. It is substantially parallelepiped-shaped. The container (1) has, at two of its opposite facing side walls (16), respective reinforcing plates (7) and is provided with a bottom seal (4), subsequently folded and sealed on the bottom (8) of the container, to strengthen it, a system for opening by means of a pull tab (6) being provided at the top of the container.

11 Claims, 3 Drawing Sheets

FIG. 3
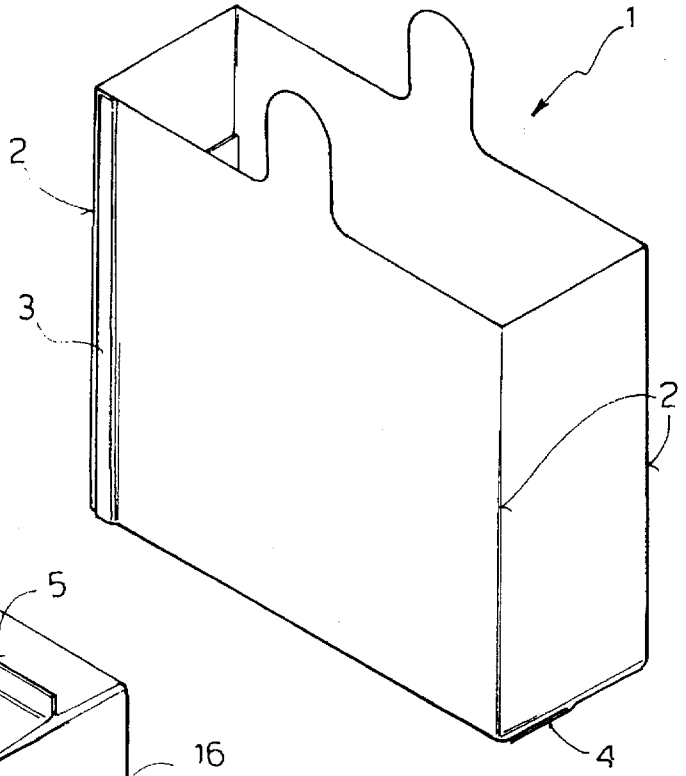
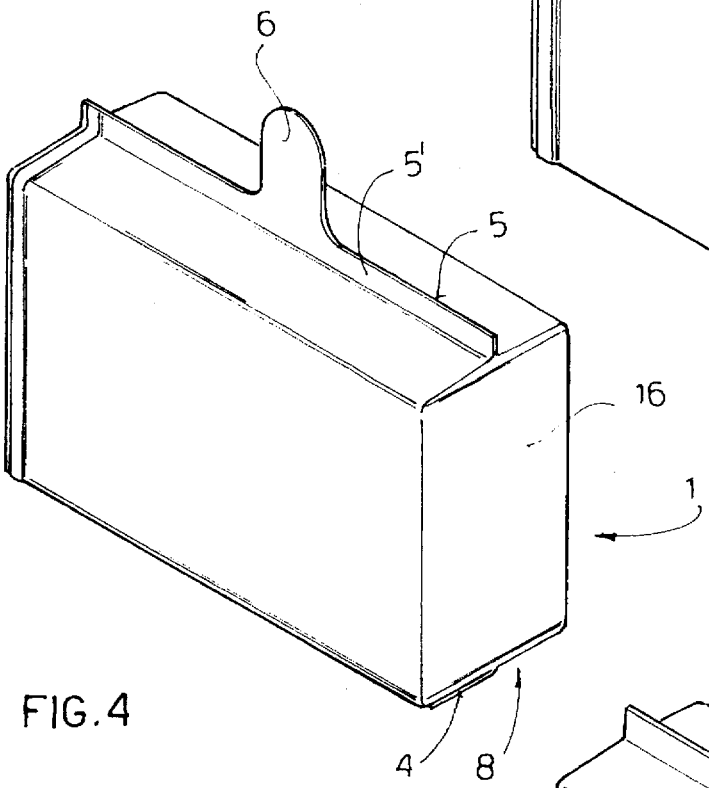
FIG. 4
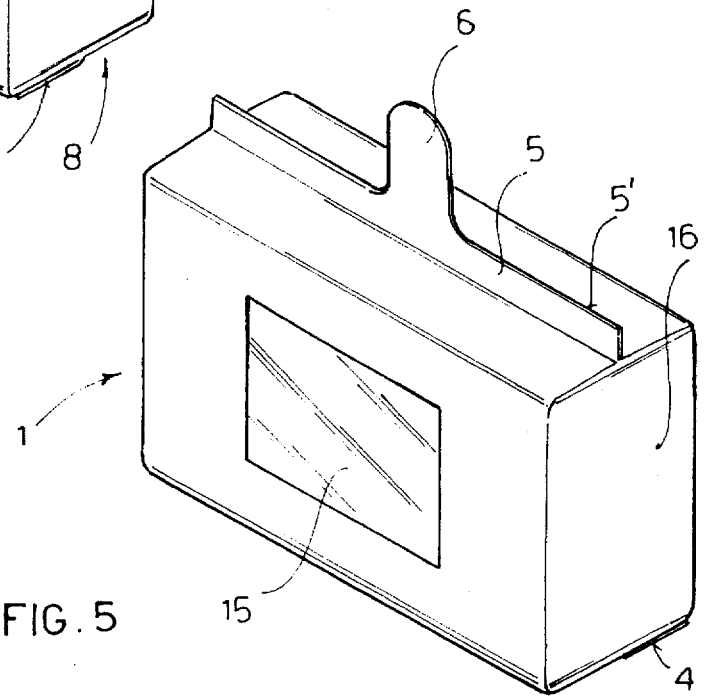
FIG. 5

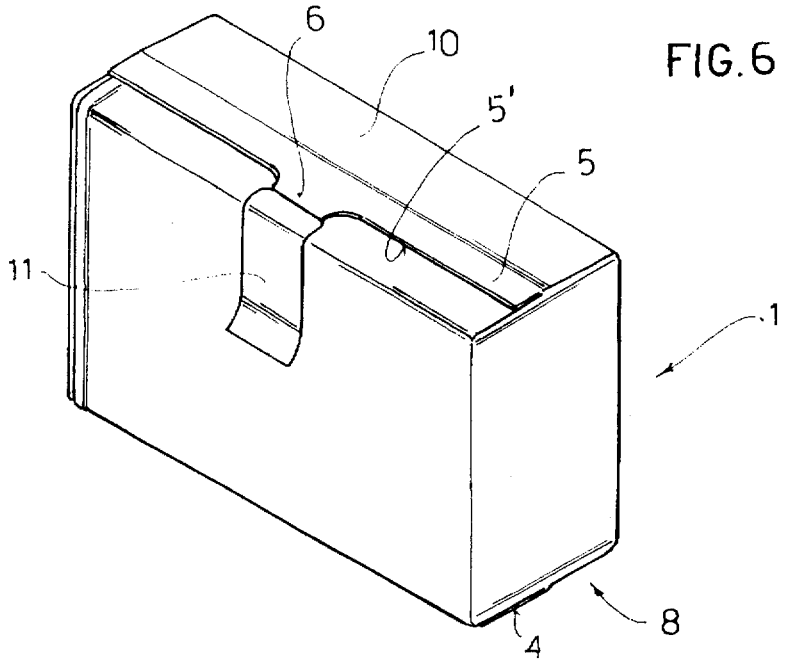
FIG.6
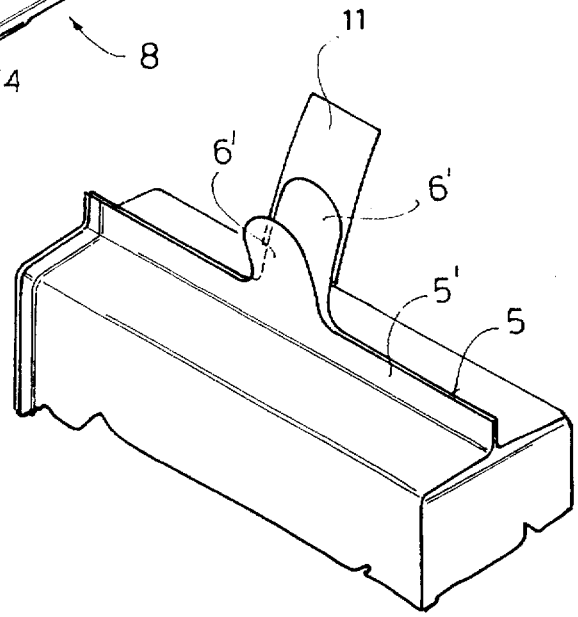
FIG.7
FIG.8
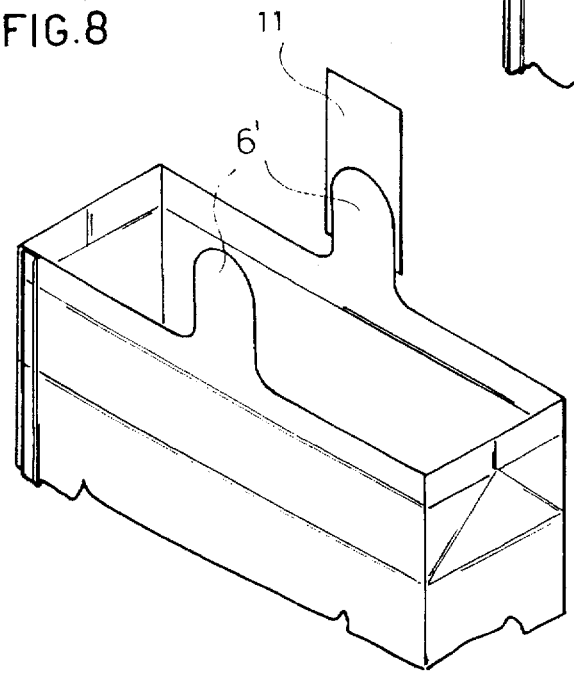

CONTAINER MADE OF FLEXIBLE SHEET MATERIAL

BACKGROUND OF THE INVENTION

The present invention relates to a container made of flexible sheet material, particularly for products with a solid consistency.

Containers of flexible sheet material, for example of the so-called bellows type, are widely known and are used to pack products of various types, for example food products, such as granular and powdered products, or in any case those with a solid consistency.

They are made of single- or multi-layered material, one or both outer surfaces being heat-sealable, for example of polyethylene. The package is obtained, in a per se known manner, by successive folds, making transverse and longitudinal seals between the superimposed parts of the sealable layers.

A drawback of these containers is that they do not keep their shape, which is normally parallelepiped, unless they arc vacuum packed and, in any case, if they are vacuum packed they tend to sag after opening.

To overcome this drawback, European patent No. 522326 in the name of Luigi Goglio, proposes a container stiffened with a base plate and a cover plate, which solves the problem of sagging of the container.

However, such a container requires a particular opening system, because of the presence of the top reinforcing plate, and, though being particularly suitable for use with products to be consumed in several portions, it is not suitable for other types of products for consumption in a single portion, or in any case that do not require tight closing of the container after it is opened for the first time.

The aim of the invention is to provide a container made of flexible sheet material that can be produced at a low cost, that maintains a substantially stiff shape and can be opened easily.

Substantially, the container of single- or multi-layered flexible sheet material, according to the invention, has respective reinforcing plates on the inside of two opposite sides, while the bottom of the container is reinforced by provision at the bottom of a fold and a seal made during formation of said container.

At the top, the container has a peel-back easy opening system.

BRIEF DESCRIPTION OF THE DRAWINGS

Further characteristics of the invention will be made clearer by the detailed description that follows, referring to a purely exemplary and therefore non-limiting embodiment, illustrated in the appended drawings in which:

FIGS. 1 to 4 show successive stages in the formation procedure, of a container according to the invention;

FIG. 5 is an axonometric view taken from the opposite side with respect to that in FIG. 4;

FIG. 6 shows the container according to the invention with the upper edge folded to one side;

FIGS. 7 and 8 show opening of the upper edge of the container.

DETAILED DESCRIPTION OF THE PREFERRED EMBODIMENTS

Figure 1:
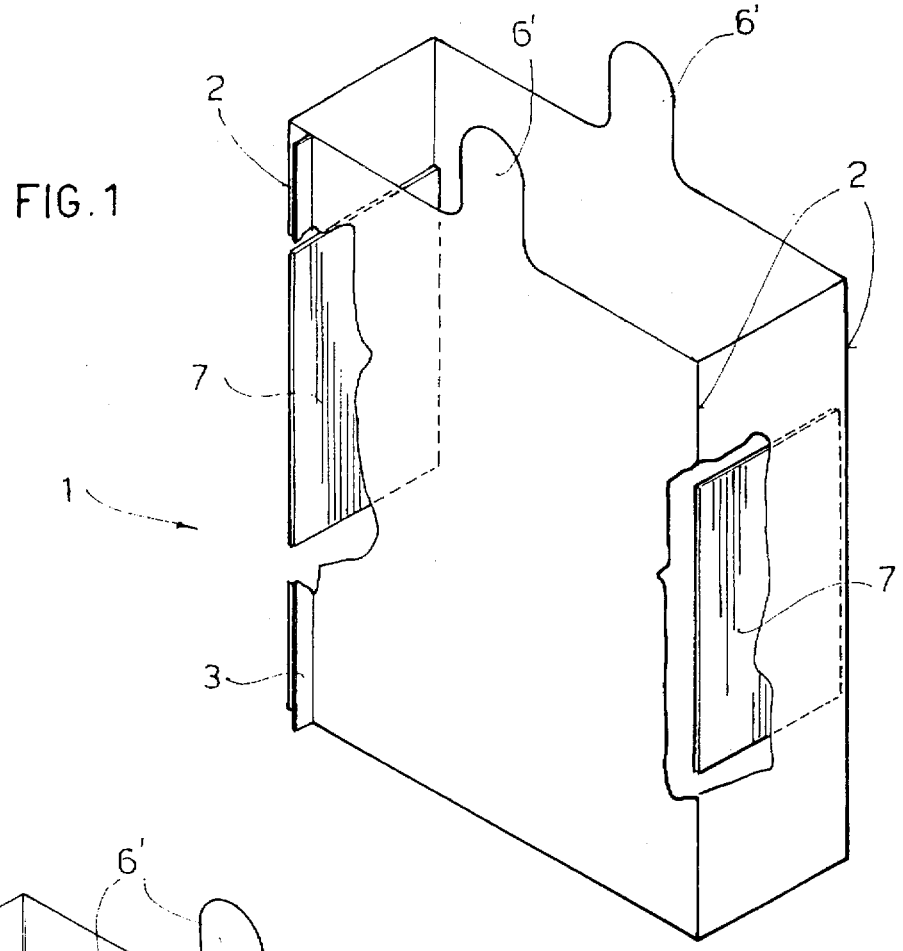
Figure 2:
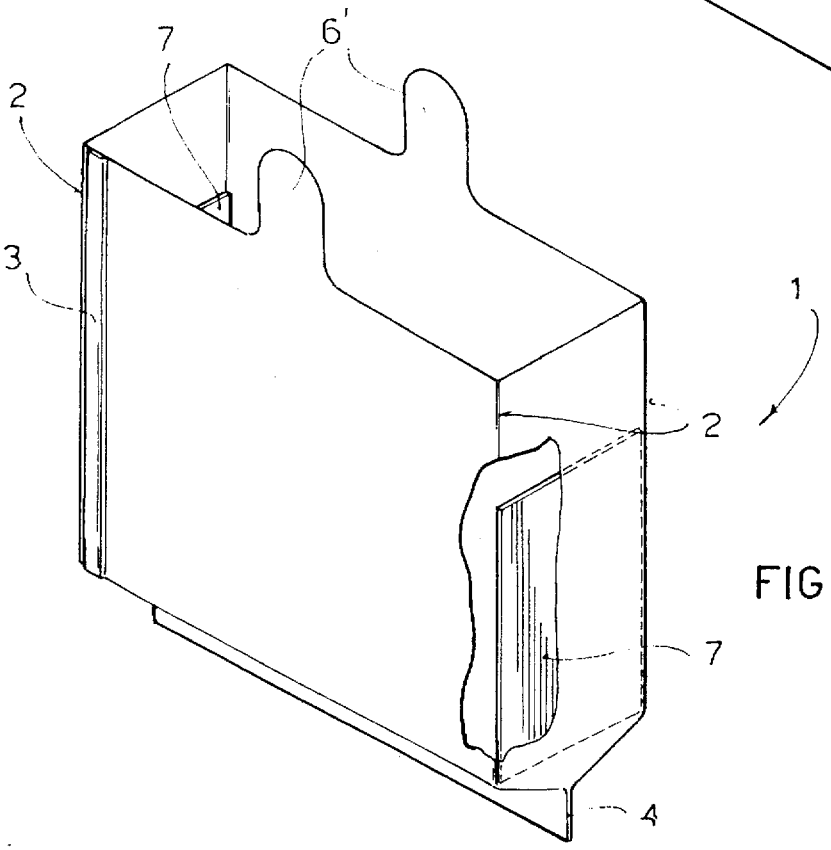

With reference to these figures, the container according to the invention has been indicated as a whole with reference number 1.

It is made from flexible sheet material, with one or more layers, capable, for example, of being heat-sealed on at least one race thereof.

The container 1 is obtained, according to a per se known method, by making folds along vertical fold lines 2 corresponding to the vertical corners, and making a vertical or longitudinal seal 3, which lies on one side face of the container, in particular in the vicinity of one of said vertical corners 2, so as to merge with said corner. A lower horizontal or transverse sealing or seal line 4 is then made, which is subsequently folded and sealed to the bottom wall of the container and an upper horizontal or transverse seal 5, thus obtaining the container as shown in FIGS. 4 and 5.

Before formation of the container 1, respective substantially rigid reinforcing plates 7 (visible in the detail in the section in FIG. 1) are placed on the inside of two facing sides and serve to strengthen the container and ensure that it maintains its erect state.

The plates 7 can be made of any suitable material, but are advantageously made of cardboard, coupled for example with an outer heat-sealable layer, to allow it to be sealed on the inside to the flexible sheet material forming the container. Alternatively, the cardboard plates 7 can be glued to the sheet material of the container.

The lower seal and fold 4, involving about half of the bottom base 8 of the container, serves to strengthen said base.

The upper transverse seal 5 determines an edge 5', with a central pull tab 6 with a rounded end. The edge 5', which has a limited height with respect to the width of the upper base 10 of the container, is folded, together with the pull tab 6, on said base, and is sealed by means of an adhesive label 1, which sticks said tab 6 to the surface of the container 1.

The label 11 has no adhesive on the end portion, to facilitate detachment during opening of the container.

As shown in FIGS. 7 and 8, detachment of the label 11 from the surface of the container 1, which advantageously stays attached to the tab 6, causes the tab 6 and the edge 5' to lift (FIG. 7).

The upper transverse sealing 5, advantageously, does not involve, or only partially involves, the tab 6, so as to leave at least an end portion not sealed, so as to facilitate gripping of the opposite free ends 6' of the tab 6 and allow opening of the container, by peeling open the upper sealing 5 which, to this end, is of the peel-back or easy-open type.

Lastly, to allow the contents of the container 1 to be viewed, a transparent window 15 (FIG. 5) can be provided on at least one of the side faces of said container, obtained by making an opening in the wall of the container and applying a transparent sheet on the inside.

The parallelepiped shape of the container 1 according to the invention is advantageously such as to have the bottom base 8 and the top base 10 elongated in the direction of said seal lines 4 and 5, so that the seal lines 4, subsequently folded and sealed to the bottom base of the container, can improve strengthening thereof. The reinforcing plates 7 are placed at the narrowest opposite side walls of the container, 1 and the transparent window 15 is therefore made in at least one of the remaining wider side walls.

Though what described above is the preferred shape of the container according to the invention, it is obvious that different shapes can be foreseen as regards the size of the various walls.

I claim:

1. A container of flexible material made according to a method comprising the steps of:

folding a sheet of flexible material along vertical corners into a substantially parallelpiped shape;

sealing opposite edges of the sheet along a vertical seam of the parallelpiped shape so as to form two opposite side walls, a front wall, and a rear wall of the container;

providing reinforcement plates on only each of the two opposite side walls of the container;

sealing bottom edges of the sheet of flexible material into a transverse seam extending between the two opposite side walls of the container to form a bottom surface of the container;

folding the transverse seam flat and sealing the transverse seam to the bottom surface of the container to reinforce the bottom surface.

2. The container of claim 1, wherein the method further comprises the step of sealing top edges of the sheet of flexible material to form an upper seal at a top of the container.

3. The container of claim 1, wherein the reinforcement plates are provided on the inside of the container.

4. The container of claim 1, wherein the reinforcement plates are heat-sealed to the inside of the container.

5. The container of claim 1, wherein the reinforcement plates are cardboard.

6. The container of claim 1, wherein the reinforcement plates are glued to the inside of the container.

7. The container of claim 2, further comprising a gripping tab at the top edges of the sheet material.

8. The container of claim 7, wherein the gripping tab is folded onto a surface of the container and is sealed thereto with an adhesive.

9. The container of claim 7, wherein the gripping tab is folded onto a surface of the container and is sealed thereto with a peel-back or easy open seal.

10. The container of claim 7, wherein one of the front and back walls includes a transparent window.

11. The container of claim 1, wherein the opposite edges of the sheet are sealed at one of the corners.

* * * * *